US005161499A

United States Patent [19]

Bachschmid et al.

[11] Patent Number: 5,161,499

[45] Date of Patent: Nov. 10, 1992

[54] V-TYPE INTERNAL-COMBUSTION ENGINE

[75] Inventors: Reiner Bachschmid, Kernen; Ernst Gobien, Weinstadt; Erhard Rau, Weilheim/Teck, all of Fed. Rep. of Germany

[73] Assignee: Mercedes-Benz AG, Fed. Rep. of Germany

[21] Appl. No.: 747,370

[22] Filed: Aug. 20, 1991

[30] Foreign Application Priority Data

Aug. 21, 1990 [DE] Fed. Rep. of Germany ..... 4026384

[51] Int. Cl.[5] ..... F02F 7/00

[52] U.S. Cl. ..... 123/195 C

[58] Field of Search ..... 123/195 C, 198 E

[56] References Cited

U.S. PATENT DOCUMENTS 4,966,106 10/1990 Aruger et al. ..... 123/195 C 4,977,870 12/1990 Hoshimoto et al. ..... 123/195 C

OTHER PUBLICATIONS

MTZ-Motortechnische Zeitschrift 48 (1987) pp. 315-323.

*Primary Examiner*—Noah P. Kamen

*Attorney, Agent, or Firm*—Evenson, Wands, Edwards, Lenahan & McKeown

[57] ABSTRACT

A V-type internal-combustion engine has two banks of cylinders, each with a cylinder-head housing which is covered by cylinder-head cover and, on each end face, by an end cover. Camshafts are driven via chain wheels by a common chain which is led through a free space between the two banks of cylinders in a well housing. To reduce jumps in sealing surfaces which present sealing problems, the well housing is arranged at a distance from the parting planes between the cylinder-head housings and cylinder-head covers and is fastened solely between the cylinder-head housings and the end covers.

10 Claims, 2 Drawing Sheets

V-TYPE INTERNAL-COMBUSTION ENGINE

BACKGROUND AND SUMMARY OF THE INVENTION

The present invention relates to a V-type internal-combustion engine, and more particularly, to the type of engine in which there are two banks of cylinders, each with a cylinder-head housing which is covered by a cylinder-head cover, and, on each end face, by an end cover and in which is arranged in at least one camshaft driven via a respective chain wheel and a common chain by a crankshaft. Between the banks of cylinders, in the region of the cylinder heads and cylinder-head covers, a free space is sealed off relative thereto and through which the chain is led in a well between the banks which is formed by a well housing sealing off from the free space.

An internal-combustion engine is shown in DE-Z MTZ 48 (1987), pages 315 to 323, in which the well is located in the region of the parting planes between the cylinder-head housings and cylinder-head covers of the two banks of cylinders. This arrangement raises considerable difficulties with regard to sealing because there is a plurality of intersecting sealing surfaces.

An object on which the present invention is based is to provide an internal-combustion engine in which the sealing difficulties arising as a result of the lead-through of the chain between the two banks of cylinders are considerably reduced.

In the above-mentioned type of internal-combustion engine, this object has been achieved by arranging the well housing at a distance from the parting planes between the cylinder-head housings and the cylinder-head covers and fastening the well housing solely between the cylinder-head housings and the end covers.

In an internal-combustion engine constructed in accordance with the principles of the present invention, the well housing forms parting planes to be sealed off only relative to the cylinder-head housings, and associated end cover, while there are no intersections with the parting planes between the cylinder-head housings and the cylinder-head covers. The possible number of jumps of sealing surfaces which are especially difficult to seal off is also consequently smaller, and therefore fewer sealing problems arise overall. The appropriate position of the chain within a cylinder head can be obtained in a simple way, for example by the deflection of the chain by way of a deflecting gearwheel which can also be formed by the chain wheel for a second camshaft in the respective bank of cylinders under which the chain is led through.

One embodiment of the present invention constitutes a substantial simplification of the well housing in relation to known arrangements in which the well covers extend simultaneously over the end faces of the two cylinder heads and cylinder-head covers. This known structure is disadvantageous in that these covers have low rigidity because of their size and are difficult to handle where machining, transport and assembly are concerned. Furthermore, the unavoidably large tolerances between the banks of cylinders necessitate further intermediate covers, via which tolerances between the well covers and auxiliary units, such as an ignition distributor, guided therein, driven by a camshaft and necessarily aligned there with have to be compensated. In contrast, the well covers according to the one embodiment of the present invention are very easy to handle because of their small dimensions. Tolerances existing between the banks of cylinders can easily be bridged thereby and have no detrimental influence on the fastening of auxiliary units to the camshafts. This is due to the face that the end cover, which is separate for each bank of cylinders and in which the auxiliary units are guided, can be readily fastened to the associated cylinder head with the necessarily narrow tolerance in relation to the driving camshaft.

Another feature of the present invention beneficially solves the principle sealing problem remaining in the region of the junction of the rear and front well cover and the two end covers. The local conjunction of three parts to be sealed off relative to one another, where the sealing is especially difficult because of the possible occurrence of jumps in the sealing run, is simplified by embedding the front well cover into a sealing element to form a more easily sealed junction of two parts to be sealed off relative to one another (namely, a well cover and a respective end cover) and of a sealing element. Also, this embodiment ensures the fastening of the front well cover simultaneously with the sealing and without any further outlay.

A still further feature of the present invention provides the seals between the rear well cover and the two end covers as part of the sealing element. The front well cover is embedded therein, so that, with the joining together of the two well covers, the sealing strips also assume their correct location. Moreover, this one-part configuration avoids a joint between the sealing element and the seals between the rear well cover and the end covers, which could result in leaks.

Another feature of the present invention guarantees the correct position of the sealing strips in the longitudinal direction of the well by arranging the longitudinal recesses, into which the sealing strips engage, in the rear well cover.

By providing the sealing strips with noses at the free ends thereof so as to face away from the rear wheel cover, the end covers, when being attached, can press the ends of the sealing strips more easily against the rear well cover and take them along in the direction of the cylinder-head housing.

The danger that the sealing strip will be damaged when the end covers are attached is reduced in accordance with the present invention by virtue of the sealing surfaces between the rear wheel cover and the end covers extending obliquely apart from one another towards the cylinder head housings.

Without a separate support for the rail having to be provided, the use of well housing to form a rail support ensures a guidance of the chain in the well and an increase of the looping angle of the chain wheels located nearest to the well.

The present invention ensures that tolerances existing between the cylinder-head housings of the two banks of cylinders have an effect solely in the longitudinal direction of the well between the well covers, on one hand, and the individual end covers, on the other hand, which tolerances are easy to control in sealing terms, whereas they have virtually no effect in the transverse direction of the well. A simply produced tolerance compensation configuration can be provided by a long hole in the second cylinder-head housing, with a longitudinal extension in the longitudinal direction of the well with fitting surfaces in transverse direction of the well.

BRIEF DESCRIPTION OF THE DRAWINGS

These and further objects, features and advantages will become more readily apparent from the following description of a presently preferred embodiment when taken in conjunction with the accompanying drawings wherein.

DETAILED DESCRIPTION OF THE DRAWINGS

Figure 1:
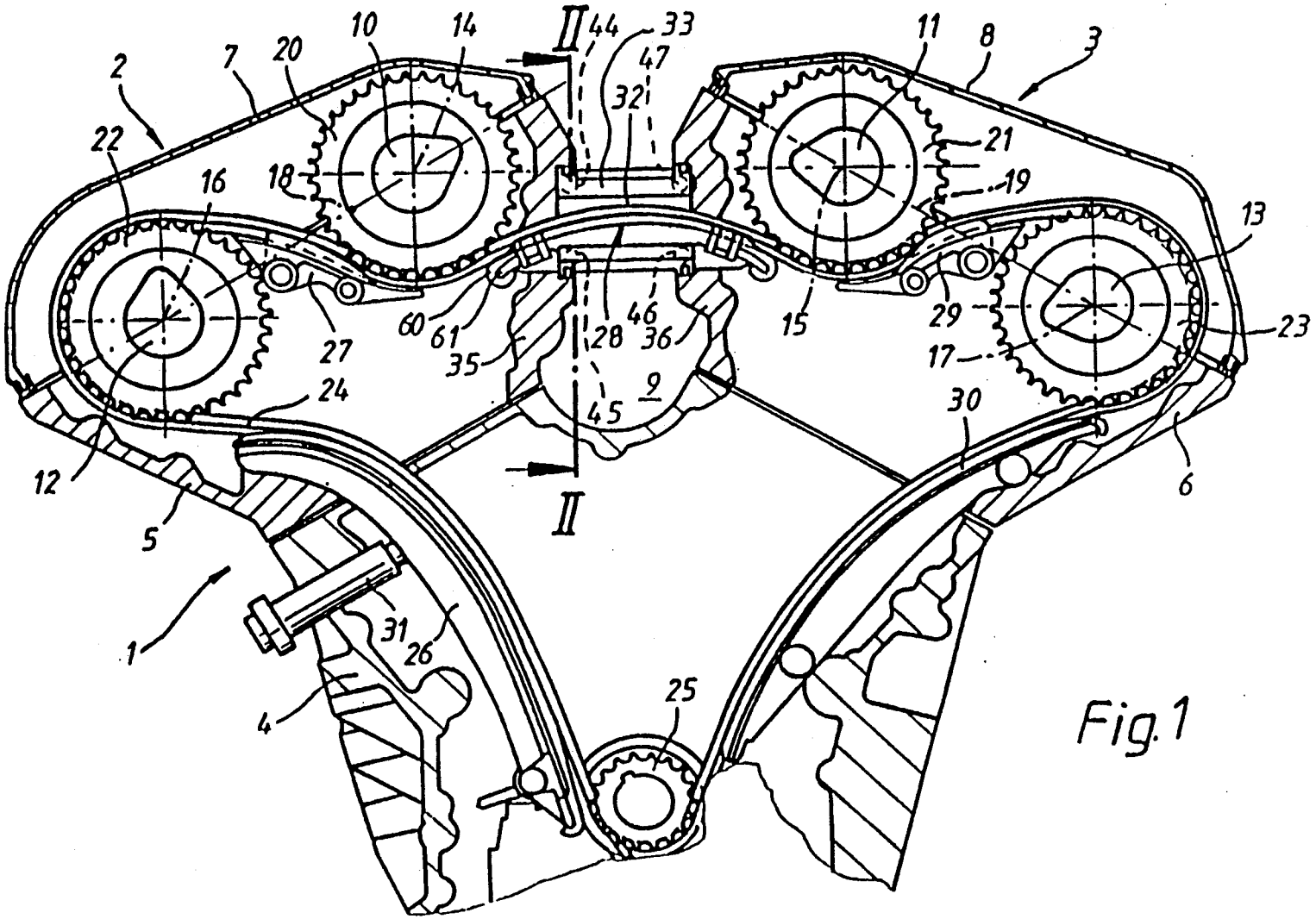
FIG. 1 is a cross-sectional view of the front end face of a V-type internal-combustion engine in accordance with the present invention with the end covers removed.
Figure 2:
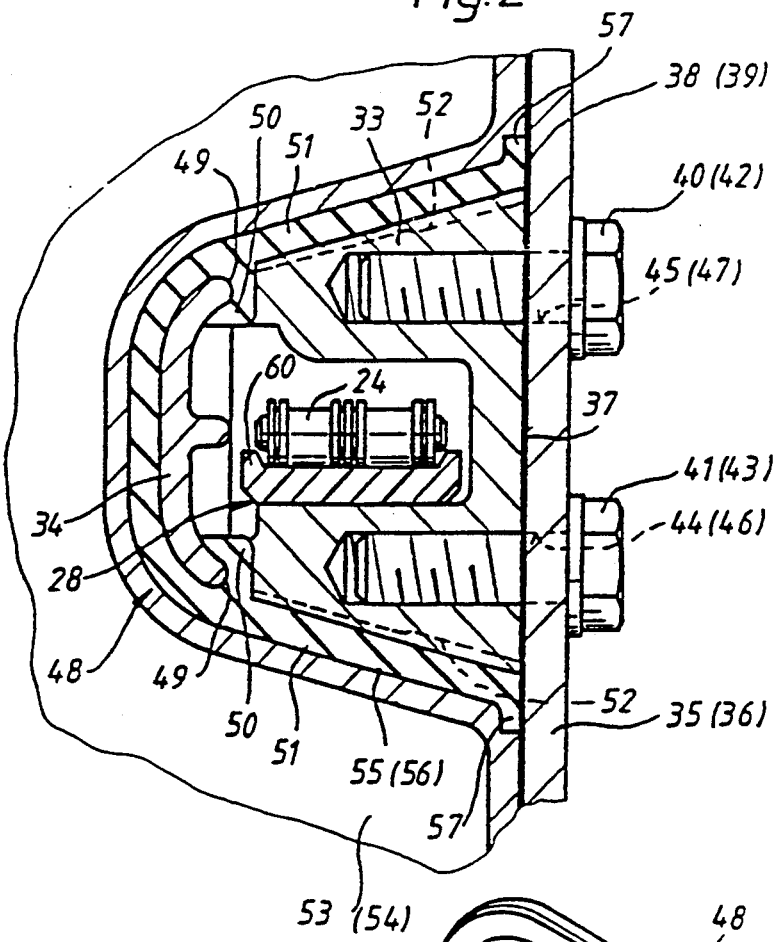
FIG. 2 is a cross-sectional view through a well housing for a chain along the line II—II of FIG. 1.
Figure 3:
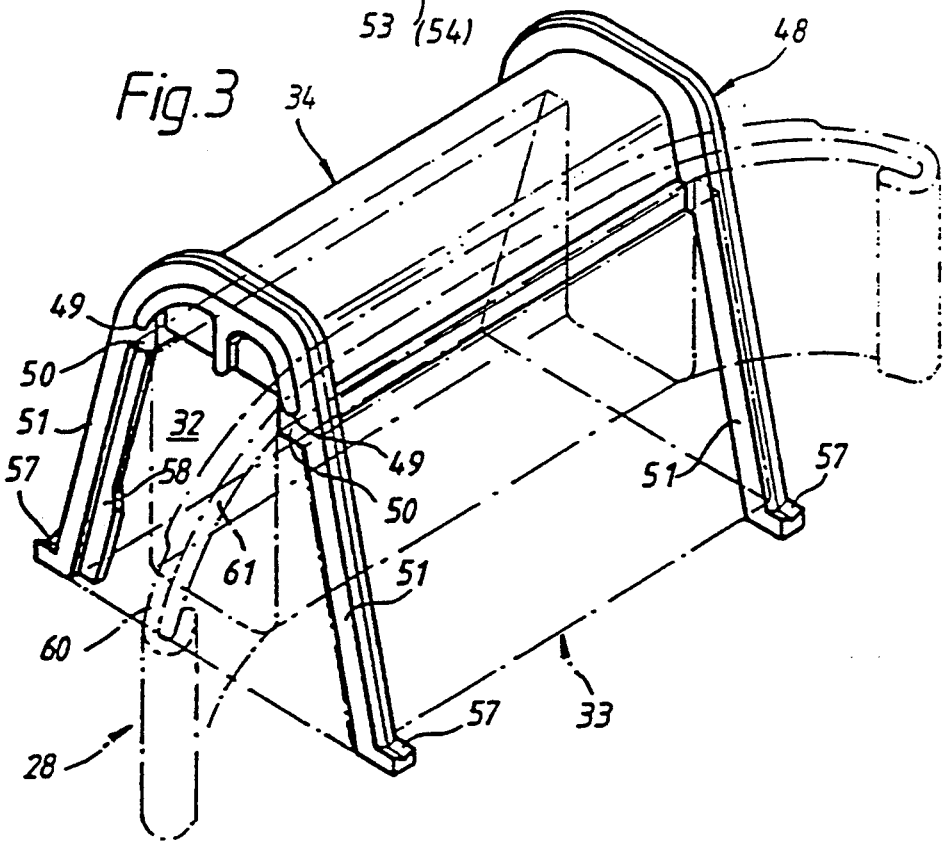
FIG. 3 is a perspective view of part of the well housing shown in FIG. 2.

FIG. 1 shows a V-type reciprocating internal-combustion engine 1 with two banks of cylinders designated generally by numerals 2, 3 which each accommodate a row of cylinders and which each have a cylinder-head housing 5, 6, respectively, attached to a common crankcase 4 and an associated cylinder-head cover 7, 8, respectively. A free space 9 extends between the two banks of cylinders 2, 3 and reaches down as far as the crankcase 4.

Arranged in each bank of cylinders 2, 3 are an inlet camshaft 10, 11 near the free space 9 and an outlet camshaft 12, 13. The axes 14 to 17 of the respective inlet and outlet camshafts lie in the parting planes 18, 19 between the respective cylinder-head housings, 5, 6 and the cylinder-head covers 7, 8. On the front end face of the internal-combustion engine 1, the camshafts 10 to 13 are connected firmly to chain wheels 20 to 23 which are driven via a chain 24 from a crankshaft chain wheel 25 located in the lower part of the crankcase 4. The chain 24 surrounds the two outer chain wheels 12, 13 over almost half the circumference and is led through under the two inner chain wheels 20, 21. To prevent chain vibrations and to increase the looping angle of the chain wheels 20 to 23 and 25, the chain is guided between these by curved chain rails 26 to 30. The chain rail 26 is configured as a tensioning rail by a hydraulic element 31 of the known construction.

The chain 24 is led through the free space 9 between the two inner chain wheels 20, 21 in the region of the chain rial 28. Since the space utilized by the chain 24 has to be screened off from the free atmosphere in an oil-tight and dust-proof manner because of its oil lubrication, the chain 24 is guided in the region of the free space 9 in a well 32 formed by two well covers 33, 34 which extend between the two cylinder-head housings 5, 6. Because the two well covers 33, 34 are not located inside the region of the two parting planes 18, 19 as a result of the guidance of the chain 24 underneath the two inner chain wheels 20, 21, the sealing problems between the well covers 33, 34 and the other parts forming the chain space are considerably reduced.

The length of the two well covers 33, 34 in the longitudinal direction of the well 32 is so limited that they extend into the cylinder heads only far enough to ensure that it is possible to screw them to the flanges 35, 36 of the cylinder-head housings 5, 6 which delimit these relative to the free space 9. At the same time, the rear well cover 33, which essentially forms the rear, upper and lower limitation of the well 32, is laid with its rear plane wall face 37 from the front onto the flanges 35, 36, with end seals 38, 39 interposed, and is screwed thereto by screws 40 to 43 applied from the rear through the flanges 35, 36. The screws 40, 41 configured as body-fit screws are inserted in fitting bores 44, 45 in one flange 35, so that the well cover 33 is accurately fit and fixed in relation to the cylinder-head housing 5. The screw 43, also configured as a body fit screw, is inserted into a long hole 46 with longitudinal extension in the longitudinal section of the well 32 in the other flange 36, so that the screw 43 has play relative to the flange 36 in the longitudinal direction of the well 32, but not play in the transverse direction of the well 32. The fourth screw 42 is inserted with play into a further bore 47 in the flange 36. The well cover 33 is thus accurately fit and fixed in all directions relative to one cylinder-head housing 5; relative to the other cylinder-head housing 6, the cover 33 is fixed with an accurate fit in the transverse direction of the well 32 and with play in the longitudinal direction of the well 32. Tolerances existing between the two cylinder-head housings 5, 6 can be bridged by the well cover 33 in this way, without impairing the seals between the individual parts to be sealed off, as described below.

To close the well 32 relative to the free space 9 after the chain 24 has been installed, the slightly curved front well cover 34, which constitutes virtually only one front limitation of the well 32, is attached from the front onto the rear well cover 33. The front well cover 34 is embedded into a sealing element designated generally by the numeral 48, for example by being vulcanized or snapped into an elastomeric material, such that its longitudinal edges 49 confronting the rear well cover 33 are surrounded by U-shaped rails 50 of the sealing element 48 and the well 32 is sealed off from the free space 9 in the parting plane between the two well covers 33, 34.

The sealing element 48 include sealing strips 51 which connect the rails 50 and which are connected to a surface of the front well cover 34, which surface faces away from the well 32, in the region of its longitudinal ends, and are continued as far as the flanges 35, 36 of the cylinder-head housings 5, 6. In this region, they bear laterally against the rear well cover 33. The strips 51 also engage, by means of ribs 58, into longitudinal recesses 52 is the well cover 33 and are thereby prevented from shifting in the longitudinal direction of the well 32.

The sealing strips 51 are pressed onto the rear well cover 33 and by end covers 53, 54 which close off a cylinder head on respective end faces, with the end seals 38, 39 interposed. At the same time, the strips 51 press the front well cover 34 onto the rear well cover 33, with the U-shaped rails 50 interposed, so that both the parting seams between the end covers 53, 54, on one hand, and the well covers 33, 34 on the other hand, and between the latter two are permanently sealed off, so that perfect sealing of the cylinder heads and of the well 32 relative to the free space 9 is guaranteed without a considerable outlay.

The end covers 53, 54, on their walls facing the free space 9, have cutouts 55, 56 which correspond to the cross-sectional contour of the well covers 33, 34 and by means of which they press against the sealing strips 51. The lateral edges of the cutouts 55, 56 extend obliquely apart from one another towards the cylinder-head housings 5, 6 so that, on the one hand, a sufficient lateral pressure force can be exerted on the sealing strips 51 and, on the other hand, the danger that the sealing strips 51 will be damaged when the end covers 53, 54 are being attached is minimized. The sealing strips 51, at their ends, possess outwardly projecting noses 57, by way of which the sealing strips 51 are pressed against the end seals 38, 39 by the end covers 53, 54, so that, in this region too, perfect sealing is guaranteed.

As is evident from the foregoing, pronounced tolerance deviations between the end covers 53, 54 and the well covers 33, 34 in the transverse direction of the well 32 would have the effect of leaks between the end covers 53, 54 and the sealing strips 51. Pronounced tolerances of this kind are, however, prevented by the above-described fastening of the well covers 33, 34 to the cylinder-head housings 5, 6 and by the individual arrangement of the end covers 53, 54 for each cylinder head. In contrast, tolerances in the longitudinal direction of the well 32 between the end covers 53, 54 and the well covers 33, 34 can be compensated in a simple way by an appropriately wide design of the sealing strips 51.

Furthermore, the chain rail 28, in the form of a plastic element 60 snapped onto a metal support 61, is arranged in the well 32. This chain rail is an integral component of the rear well cover 33, and there is therefore no need for a separate part to be produced and fastened.

Although the invention has been described and illustrated in detail, it is to be clearly understood that the same is by way of illustration and example, and is not to be taken by way of limitation. The spirit and scope of the present invention are to be limited only by the terms of the appended claims.

We claim

1. A V-type internal-combustion engine, comprising two banks of cylinders each bank with a cylinder-head housing which is covered by a respective cylinder-head cover and, on each end face, by a respective end cover, a crankshaft, at least one camshaft operatively arranged and driven, via respective chain wheel and a common chain, by the crankshaft, and a sealed-off free space between the banks of the cylinders in the region of the cylinder heads and cylinder-head covers through which the chain is led in a well between the banks formed by a well housing sealing off the free space, wherein the well housing is arranged at a distance from parting planes defined between the cylinder-head housings and the cylinder-head covers and is fastened solely between the cylinder-head housings and the end covers.

2. The internal-combustion engine according to claim 1, wherein the well housing comprises front and rear well covers which surround the well and which, in the longitudinal direction of the well, terminate immediately adjacent sealing surfaces to seal off the cylinder heads relative to the free space, between the cylinder head housings and the respective associated end covers each covering a cylinder head on its end face.

3. The internal-combustion engine according to claim 2, wherein the rear well cover is fastened directly to the cylinder-head housings, and the front well cover is embedded into a sealing element which forms a seal between the well covers and, between the front well cover and the end covers, is pressed by the end covers onto the rear well cover.

4. The internal-combustion engine according to claim 3, wherein the sealing element includes, as extensions of the seals between the front well cover and the end covers, sealing strips which extend near the longitudinal ends of the rear well cover laterally thereof to the parting planes between the rear well cover and the cylinder-head housings, which sealing strips are pressed by the end covers against the rear well cover.

5. The internal-combustion engine according to claim 4, wherein longitudinal recesses, into which the sealing strips longitudinally engage, are arranged in the rear well cover.

6. The internal-combustion engine according to claim 4, wherein the sealing strips have a free end at which a nose is provided to face away from the rear well cover.

7. The internal-combustion engine according to claim 4, wherein sealing surfaces between the rear well cover and the end covers extend obliquely apart from one another towards the cylinder-head housings.

8. The internal-combustion engine according to claim 1, wherein a chain deflecting rail is arranged in the well, and a rail support is formed by the well housing.

9. The internal-combustion engine according to claim 1, wherein the rear well cover is screwed to the cylinder-head housings and is fastened relative to one cylinder-head housing with an accurate fit in longitudinal and transverse directions of the well via fitting guide means and relative to the other cylinder-head housing with an accurate fit only in the transverse direction of the well and freely in the longitudinal direction of the well.

10. The internal-combustion engine according to claim 9, wherein a long hole adapted to fasten the rear well cover is provided in the other cylinder-head housing with a longitudinal extension in the longitudinal direction of the well and with fitting surfaces in the transverse direction of the well.

* * * * *